United States Patent [19]

Habisohn

[11] 4,152,864

[45] May 8, 1979

[54] DEVICE FOR FORMING BUBBLES FROM PLANAR FILM SHAPES

[76] Inventor: Victor J. Habisohn, 252 Englewood Rd., Hoffman Estates, Ill. 60195

[21] Appl. No.: 704,347

[22] Filed: Jul. 12, 1976

[51] Int. Cl.[2] ..... A63H 33/28; A63H 33/12

[52] U.S. Cl. ..... 46/6; 46/29

[58] Field of Search ..... 138/115, 116, 117; 285/131; 46/29, 151, 6, 7, 8; 239/33; 264/100; 425/275

[56] References Cited

U.S. PATENT DOCUMENTS

| | | | |
|---|---|---|---|
| 517,118 | 3/1894 | Horton | 46/7 |
| 585,057 | 6/1897 | Stone | 239/33 |
| 585,058 | 6/1897 | Stone | 138/115 |
| 814,367 | 3/1906 | Given | 46/29 |
| 851,782 | 4/1907 | Soss | 46/6 |
| 1,092,217 | 4/1914 | Hopkins | 46/29 |
| 1,155,470 | 10/1915 | Crossman | 46/7 |
| 1,364,881 | 1/1921 | Koch | 46/151 |
| 2,238,833 | 4/1941 | Tillotson | 425/275 |
| 2,409,471 | 10/1946 | Brosseit | 46/6 X |
| 2,461,271 | 2/1949 | Habib et al. | 264/100 |
| 2,606,395 | 8/1952 | Fulton | 46/6 |
| 2,711,612 | 6/1955 | Wister | 46/7 |
| 2,839,868 | 6/1958 | Lathrop | 46/8 |
| 3,176,428 | 4/1965 | Slingluff | 46/29 X |
| 3,443,337 | 5/1969 | Ehrlich | 46/6 |

FOREIGN PATENT DOCUMENTS

| | | | |
|---|---|---|---|
| 1321281 | 6/1973 | United Kingdom | 46/29 |

OTHER PUBLICATIONS

Games of the World, Ed. by. F. V. Grunfeld, Pub. by Holt, Rinehart and Winston, N.Y.C., N.Y., 1975, pp. 276-277 relied on.

*Primary Examiner*—F. Barry Shay
*Attorney, Agent, or Firm*—Jerome Goldberg

[57] ABSTRACT

A craft kit and method for forming "thin film" shapes or forms. The kit includes various parts for forming a multitude of different solid configurations, which are dipped into film producing solution for deriving "thin film" planar shapes determined by the solid configuration. A bubble forming tool, which may include a bubble generator and a bubble sucker, is used to provide three dimensional thin film configurations determined by the solid configuration and the thin film shapes. For example, a cube configuration will enable substantially cube shaped bubbles to be formed in the thin film planar shapes.

6 Claims, 14 Drawing Figures

DEVICE FOR FORMING BUBBLES FROM PLANAR FILM SHAPES

BACKGROUND OF THE INVENTION

The invention relates generally to a craft kit for building objects, particularly geometric configurations. More specifically, the subject invention relates to a craft kit for forming thin film configurations and the method for forming such configurations.

Various craft kits have been used in the past for forming geometric configurations. These were generally cumbersome and not suitable for use in forming thin film shapes or forms. The subject invention is particularly directed to form a multitude of configurations which are suitable for forming thin film shapes or forms utilizing conventional bubble forming liquid commonly used by children for blowing bubbles.

Dipping geometric shapes into film forming solution has been done in the past for forming thin film shapes, using the principle that the film will stretch between points to form the minimal surface areas. A minimal surface is the minimum area defined by the intersection of two or more 2-dimensional planes — the concept being similar to the commonly known geometric principle that the shortest distance between two points is a straight line.

In the method disclosed herein, thin film shapes of bubbles are formed inside the minimal area surfaces. For example, cube bubbles or hexagonal or octagonal 3-dimensional bubbles may be formed inside the minimal surface areas, but such bubble shape is dependent upon the shape of the minimal surfaces, which, in turn, are dependent upon the solid configuration dipped into the film forming solution.

It is, therefore, a primary object of the subject invention to provide a plurality of component parts for constructing a multitude of solid configurations suitable for forming 3-dimensional bubble shapes dependent upon the constructed configurations.

Another primary object is to provide a bubble producing means, for forming thin film 3-dimensional bubbles inside of the miminal thin film surface areas of a solid configuration.

Another object is to provide a bubble sucker for removing unwanted bubbles from the thin film shapes supported by a solid configuration.

Another object is to provide a solid configuration suitable for forming thin film minimal surfaces, after being dipped into a thin film producing solution.

A feature of the subject invention is to provide a rod having a pair of openings separated by an intermediate wall extending therethrough, and joints dimensioned to fit into either of said openings for forming a plurality of solid configurations.

BRIEF DESCRIPTION OF THE DRAWINGS

Referring now to the drawings, in which the same characters of reference are employed to indicate corresponding similar parts throughout the several figures of the drawings.

DESCRIPTION OF THE PREFERRED EMBODIMENT

Figure 1:
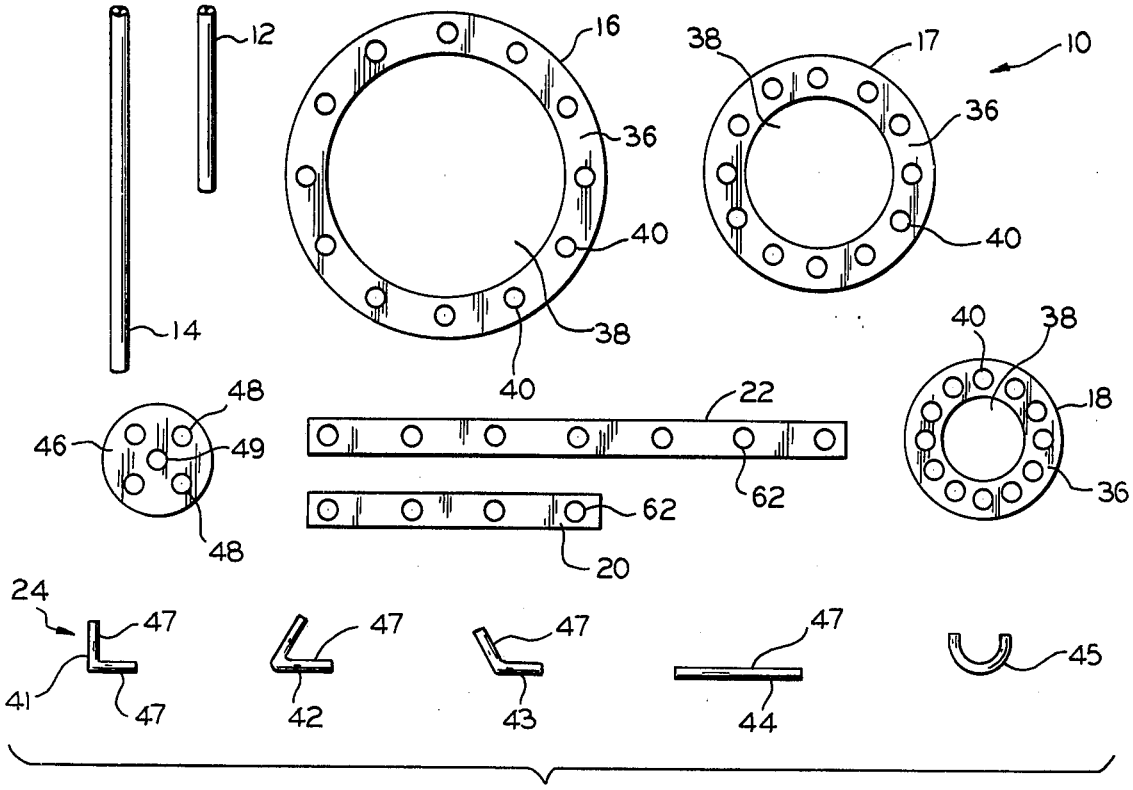
FIG. 1 is a perspective view of the various component building blocks for constructing a plurality of configurations, embodying the principles of the invention.

Referring now to FIG. 1 of the drawings, the reference numeral 10 indicates generally a plurality of parts included in a craft kit, for assembling or constructing a multitude of configurations to form corresponding "thin film" shapes. The parts comprise elongated cylindrical rods 12 and 14; rings 16, 17 and 18; rectangular strips 20 and 22; and various connecting joints generally identified by numeral 24.

The assembled configuration is dipped into a "film" producing liquid 26 (FIG. 10) to produce thin film surfaces stretched across and between the various parts 10 used in the assembled configuration. The shape of the thin film surfaces is dependent upon the shape of the assembled solid configuration.

Figure 8:
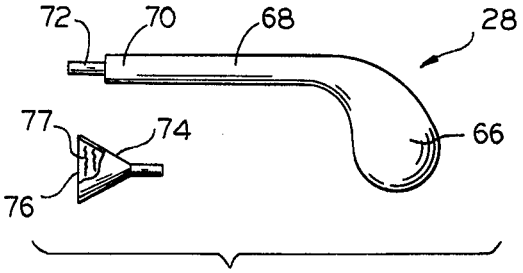
FIG. 8 illustrates the bubble producing means including a flared nozzle for producing larger bubbles.

A bubble producing means 28 is provided to apply or create bubbles in the film, and the shape of such bubbles being determined by the shape and contour of the "thin film" surfaces (FIG. 8).

Figure 2:
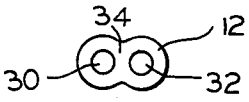
FIG. 2 is an end view of the rod to illustrate the pair of openings in the rod.
Figure 3:
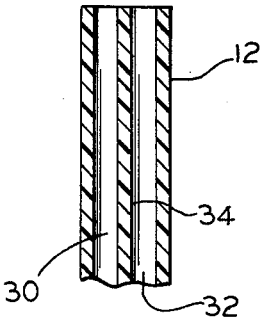
FIG. 3 is a cross-sectional view of the rod.
Figure 4:
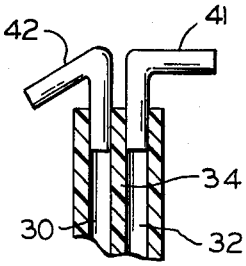
FIG. 4 is a fragmentary view to illustrate the joints received in the openings of the rod.

The cylindrical rod 12 is approximately one half the length of the cylindrical rod 14. Each cylindrical rod 12, 14 includes two openings 30 and 32 separated by a center wall 34. The openings 30, 32 extend throughout the longitudinal length of the rod (see FIGS. 2 and 3). Preferably, the rods 12, 14 are flexible. The rods 12, 14 may vary in length otherwise than two to one.

The rings 16, 17 and 18 each comprises an outer rim 36 defining a central hole 38. The rings 16, 17 and 18 vary in increasing size. Each ring includes a plurality of apertures 40 formed in the rim 36, which in the illustrative embodiment number twelve apertures 40 per ring, and spaced 30 degrees apart. The apertures receive the rods 12, 14 in a press fit attachment.

The connecting joints 24 include a ninety degree joint 41; a sixty degree joint 42; a one hundred twenty degree joint 43; a one hundred eighty degree joint 44; a substantially "U" shaped joint 45; and an apertured disc joint 46. The joints 41, 42, 43, 44 and 45 are formed with a pair of fingers 47 for extending into the openings 30, 32 of the rods 12, 14. The joint 46 includes four outer apertures 48 and a central aperture 49. The apertures 48 and 49 are dimensioned to receive the rods 12, 14.

Figure 5:
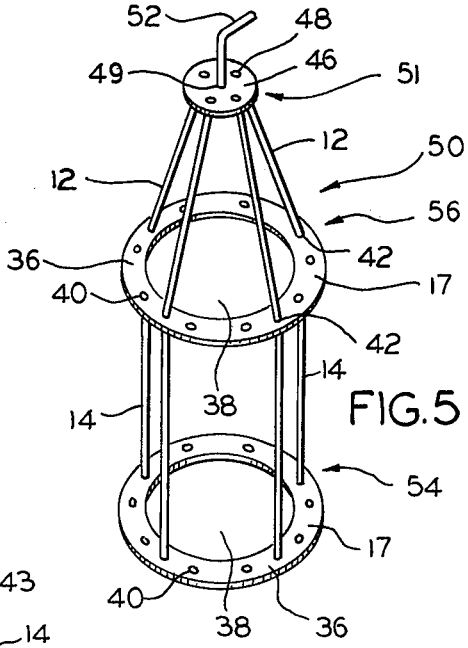
FIG. 5 illustrates a substantially cube-pyramid configuration constructed with rings, rods and various joints.

Turning now to FIG. 5, a configuration identified generally by the reference numeral 50 is shown. The configuration 50 is constructed from a pair of spaced apart rings 7 connected together by the rods 14, and the upper ends of such rods 14 extend into the apertures 40 and are linked to rods 12 by the connecting joint 43. The opposite or upper ends of the rods 12 are joined together by the disc joint 46 to form an apex 51. Another rod 14 is attached to the apex 51 via the central aperture 49 of the disc joint 46, and functions as a handle 52 when dipping the configuration 50 into the film producing liquid 26. Thus, the configuration 50 includes a bottom form 54 and a top or pyramid form 56. The bottom form 54 and the top pyramid form 56 are determined by the number of apertures 40 of the rings 17 used, the number of openings 30, 32 used in the rods 12, 14 and the type of joints 24 selected. A thin film substantially cubed shaped bubble may be formed in the solid form 54, since the rods 14 are positioned on the ring 17 ninety degrees apart, and the method for forming such thin film bubbles will be more fully discussed further in the description. However, a "house" shaped bubble (not shown) may be formed in the complete configuration.

Figure 6:
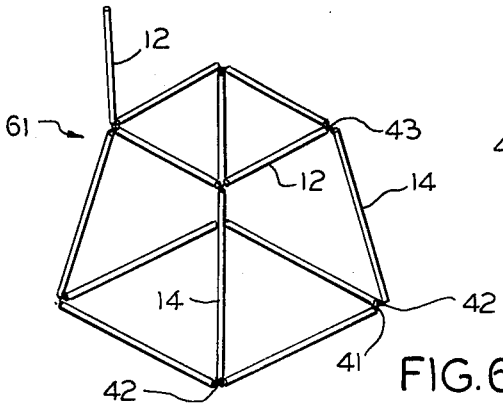
FIG. 6 illustrates a frustrum configuration constructed with rods and various joints.
Figure 10:
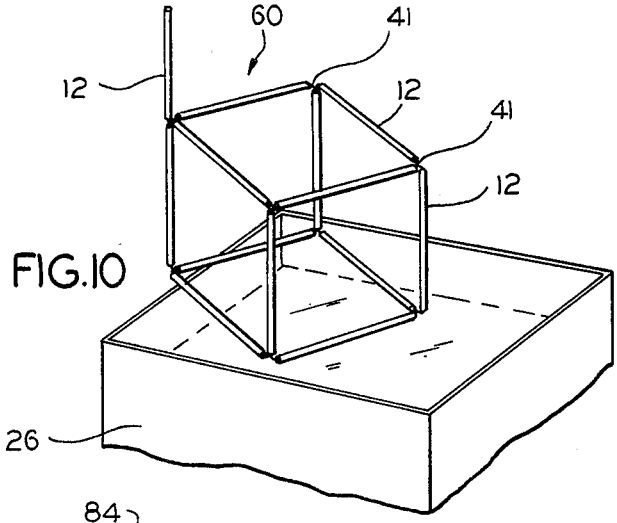
FIG. 10 illustrates a cube configuration spaced above a "film" producing solution prior to being dipped therein.
Figure 11:
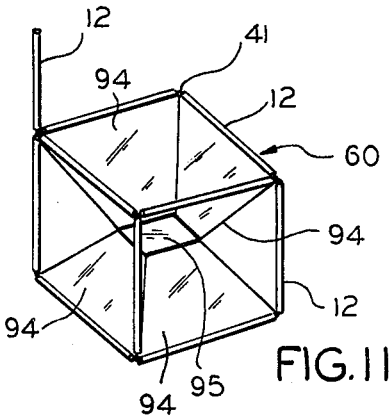
FIG. 11 illustrates the "thin film" shape after the cube configuration had been dipped into the "film" producing solution.
Figure 12:
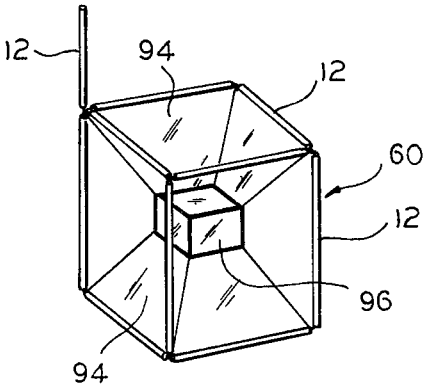
FIG. 12 illustrates the cube bubble produced by the injecting a bubble with the bubble producing means inside the "thin film" shape of FIG. 11.

The square configuration 60 shown in FIGS. 10, 11 and 12, is formed with the cylindrical rods 12 connected together by the right angle joints 41. The trapezoidal configuration 61 shown in FIG. 6 is constructed with rods 12 and 14. The base of the trapezoid includes the rods 14 connected together with joints 41, the lower ends of the side rods 14 are connected to the base with joints 42, and the upper ends of the side rods 14 are connected to the top rods 12 with the joints 43.

Figure 7:
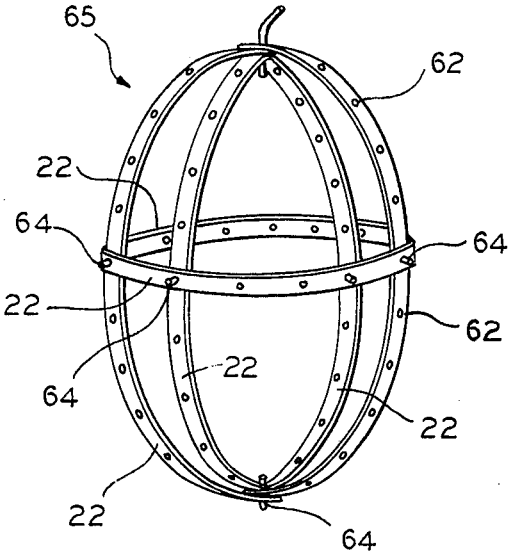
FIG. 7 illustrates a curved configuration constructed primarily with rectangular strips.

The strips 20, 22 are flexible and have a plurality of spaced apart apertures 62 formed therein. As shown in FIG. 7 a plurality of strips 22 are joined together with pieces 64, which may be cut pieces from the rod 12 or 14, to form the curved, arcuate configuration 65. Such configuration 65 forms an octahedron thin film shape (not shown) after dipping into the film producing solution 26.

Turning now to FIG. 8, the bubble producing means 28 is shown in a gun shape comprising a hollow flexible handle 66 for generating an air stream into the barrel 68 to finally flow out from the outer end 70. A removable tip 72 is shown positioned in the outer end 70. If liquid film producing solution 26 is contained on the tip 72, bubbles will be produced as the air stream passes through the tip 72.

An enlarged tip 74 having a flared or bevelled opening 76 may be press fitted on the outer 70, for producing larger bubbles than the top 72 when the handle 66 is compressed. The tip 74 may include serrations 77 on the inside thereof to retain pockets of film solution 26.

To form bubbles in the thin film surfaces formed after dipping into the film forming solution 26, the tip 72 or 76 should be in contact with the thin film surfaces when the handle 66 is compressed.

Figure 9:
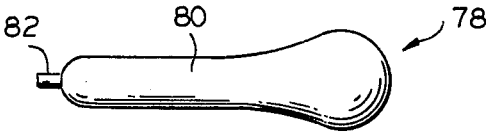
FIG. 9 illustrates a bubble sucker for sucking out unwanted bubbles.

In FIG. 9, a bubble sucker is shown and identified by the reference numeral 78. The bubble sucker 78 includes a flexible body 80 having an outer tip 82, which may be removable. Air is ejected from the tip 82 when the body 80 is compressed. Therefore, to vary the size of a thin film shape or to remove unwanted bubbles from the thin film surfaces, the body 80 is compressed and than the tip 82 is placed in contact with one of the film surfaces defining the bubble or thin film shape. As the compressed force is removed from the body 80 of the sucket 78, the suction draws the air from the bubble or film shape into the body 80 of the sucker 78, to reduce or completely deflate the bubble or film shape.

Figure 13:
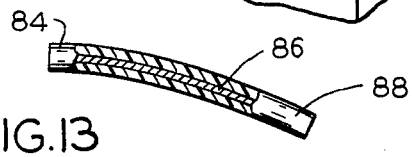
FIG. 13 illustrates a flexible joint, for varying the shape of the joints.

Turning now to FIG. 13, a flexible joint 84 may be used for connecting the rods 12, 14 together to form the various configurations including but not limited to the combination cube and pyramid 50, the cube 60 and the trapezoid 61. The joint 84 may be shaped into virtually any angle, so that the configurations that can be constructed with the rods 12, 14 and the flexible joint 84 are almost limitless. The flexible joint 84 comprises conventional copper wire 86 coated with plastic 88, and is dimensioned to fit into the openings 30, 32 of the rods 12, 14. Joint 84 is non-elastic.

Figure 14:
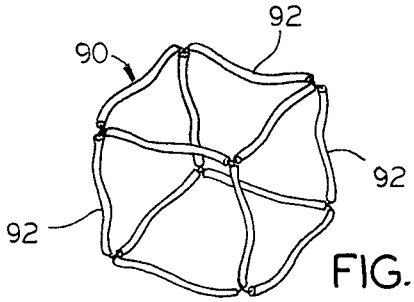
FIG. 14 illustrates a flexible configuration for varying the shape of such configuration prior to dipping into the film producing solution.

FIG. 14 illustrates a cube identified generally by the numeral 90, and is built with flexible bars 92, which may be constructed from the same material as the flexible joint 84, such as plastic coated copper wire. The ends of the bars 92 are stripped of the plastic coat and are soldered or otherwise joined to form the cube 90. Since the bars 92 are flexible and the shapes thereof may be permanently varied, a plurality of different shapes may be formed from a single solid configuration, which in turn, affords an additional plurality of thin film shapes that can be formed from the same configuration 90 upon dipping into the film forming solution 32 and injecting bubbles into the thin films with the bubble producing means 28.

Referring now to FIGS. 10, 11 and 12, the method for forming thin film shapes will be described. The cube configuration 60 is dipped in the film producing solution 26, to produce thin films 94 stretching between the rods 12 to form the minimal surfaces. Centrally positioned in the films 94 is a substantially square film shape 95 which is formed due to the tensions in the films 94, caused by the cooperation of the minimal area surfaces 94 and the cube solid configuration 60.

The tip 62 of the bubble producing means 28 is dipped in the film forming solution 26, and then the tip 62 is positioned adjacent the square film area 95, and the handle 66 is compressed to force air out from the tip 72 and into the square area 95, to cause the square area 95 to expand outward. The expanded square area 95 takes the shape of the solid configuration 60, to form the cube bubble 96. If the trapezoid 61 were dipped into the film forming solution 26, the minimal surface films would produce a centrally positioned square, and thereafter injecting a bubble adjacent the film square would produce a trapezoidal bubble (not shown). If, for example, a square base pyramid were constructed a square film area would be produced inside the minimal surface films of the pyramid configuration after being dipped in the film forming solution, and the injecting of air with the bubble producing means 28 will produce a substantially pyramid bubble. As aforesaid, the configuration 50, enables a square bubble to be produced in the configuration 54 and a pyramid bubble in the upper configuration, or a combination bubble if the air is injected in the film at the proper position (adjacent the upper ring 17), having a a substantially "house" shaped configuration.

Moreover, if an hexagonal or octagonal shape is constructed from the component parts 10, an hexagonal or octagonal bubble may be produced by injecting air inside the mimimal surface films with the bubble producing means.

The description of the preferred embodiments of this invention is intended merely as illustrative of the subject invention, the scope and limits of which are set forth in the following claims.

I claim:

1. A device for producing thin film shapes and forms comprising:

film producing liquid;

means for forming polyhedral bubble shapes including a skeletal confuguration for inserting into said liquid, said skeletal configuration including a plurality of rods, each of said rods including a first pair of openings on one end and a second pair of openings on the opposite end;

means for coacting with said openings to connect either of said ends of one said rod with two other said ends of any two other said rods and comprising joint members, each of said joint members having but two ends, said ends of each of said joint members being insertable in said openings for securing two of said rods together, said skeletal configuration being shaped to suspend said liquid in thin film planar shapes wherein one said planar shape is supported by other said planar shapes, which are, in turn, supported by said skeletal configuration; and inflating means for producing a three dimensional film form from said liquid, determined by the shape of said skeletal configuration and said one thin film shape.

2. The device of claim 1, wherein said joint member includes a flexible metal wire coated with an outer flexible covering.

3. The device of claim 2, wherein:

each of said rods is hollow and includes an inner wall dividing the rod into a first cavity and a second cavity, said first cavity communicating one opening of said first pair with one opening of said second pair, and said second cavity communicating the other opening of the first pair with the other opening of the second pair.

4. The device of claim 1, wherein said joint member is a flexible joint member bendable along any point therealong to enable construction of substantially any configuration with said rods and said flexible joint member.

5. The device of claim 1, wherein said joint members include a fixed angled joint.

6. The device of claim 1, wherein said rods include flexible rods, said flexible rods enabling the shape of said configuration to be varied for varying said 3-dimensional film shape.

* * * * *